US012234628B2

(12) United States Patent
Li et al.

(10) Patent No.: US 12,234,628 B2
(45) Date of Patent: Feb. 25, 2025

(54) BOOM CORRECTION METHOD AND DEVICE FOR WORKING MACHINE

(71) Applicant: SHANGHAI SANY HEAVY MACHINERY CO., LTD, Shanghai (CN)

(72) Inventors: Ceng Li, Shanghai (CN); Jialin Song, Shanghai (CN); Chuanyu Wang, Shanghai (CN)

(73) Assignee: SHANGHAI SANY HEAVY MACHINERY CO., LTD., Shanghai (CN)

( * ) Notice: Subject to any disclaimer, the term of this patent is extended or adjusted under 35 U.S.C. 154(b) by 20 days.

(21) Appl. No.: 18/449,825

(22) Filed: Aug. 15, 2023

(65) Prior Publication Data

US 2024/0003122 A1 Jan. 4, 2024

Related U.S. Application Data

(63) Continuation of application No. PCT/CN2022/077677, filed on Feb. 24, 2022.

(30) Foreign Application Priority Data

Mar. 16, 2021 (CN) ..... 202110282174.1

(51) Int. Cl.
*E02F 9/26* (2006.01)

(52) U.S. Cl.
CPC ..... *E02F 9/268* (2013.01)

(58) Field of Classification Search
CPC ..... E02F 9/265; E02F 9/268
See application file for complete search history.

(56) References Cited

U.S. PATENT DOCUMENTS 11,179,851 B2 * 11/2021 Oaki ..... B25J 9/1671
12,012,728 B2 * 6/2024 Kim ..... G01L 19/0007
(Continued)

FOREIGN PATENT DOCUMENTS

CN 1651666 A 8/2005
CN 107030699 A 8/2017
(Continued)

OTHER PUBLICATIONS

First Office Action issued in counterpart Chinese Patent Application No. 202110282174.1, dated Jan. 11, 2022.
(Continued)

*Primary Examiner* — Tyler J Lee
(74) *Attorney, Agent, or Firm* — Westbridge IP LLC

(57) ABSTRACT

Disclosed are a boom correction method and a boom correction device for a working machine. The method includes: inputting an actual displacement value of a boom of a target working machine at a current moment and a first operating parameter of the target working machine at the current moment into a prediction model, and outputting a predicted displacement value of the boom at a next moment of the current moment; and calculating a difference between the predicted displacement value of the boom and a preset displacement value, and in response to that the difference is greater than a first preset threshold, adjusting a second operating parameter of the target working machine according to the difference to correct the boom of the target working machine; both the first operating parameter and the second operating parameter are related to a displacement of the boom.

6 Claims, 3 Drawing Sheets

(56) References Cited

U.S. PATENT DOCUMENTS

| | | | | |
|---|---|---|---|---|
| 2004/0093119 | A1* | 5/2004 | Gunnarsson | B25J 9/1638 700/245 |
| 2012/0296471 | A1* | 11/2012 | Inaba | B25J 9/1694 901/42 |
| 2014/0222207 | A1* | 8/2014 | Bowling | B25J 13/00 700/261 |
| 2020/0070346 | A1 | 3/2020 | Oaki | |
| 2020/0362889 | A1* | 11/2020 | Hodel | G06N 3/084 |
| 2021/0043085 | A1* | 2/2021 | Kreiling | E02F 3/96 |
| 2021/0340725 | A1* | 11/2021 | Velde | G05G 5/12 |
| 2022/0049477 | A1* | 2/2022 | Yamanaka | G06F 18/214 |
| 2022/0154430 | A1* | 5/2022 | Kim | E02F 9/267 |

FOREIGN PATENT DOCUMENTS

| | | | |
|---|---|---|---|
| CN | 108691324 | A | 10/2018 |
| CN | 110485502 | A | 11/2019 |
| CN | 110977991 | A | 4/2020 |
| CN | 111343854 | A | 6/2020 |
| CN | 112091977 | A | 12/2020 |
| CN | 112975983 | A | 6/2021 |
| JP | H07305519 | A | 11/1995 |
| WO | 2007014832 | A1 | 2/2007 |

OTHER PUBLICATIONS

Grant Notification issued in counterpart Chinese Patent Application No. 202110282174.1, dated Feb. 8, 2022.

International Search Report and Written Opinion issued in corresponding PCT Application No. PCT/CN2022/077677, dated May 9, 2022.

* cited by examiner

BOOM CORRECTION METHOD AND DEVICE FOR WORKING MACHINE

CROSS-REFERENCE TO RELATED APPLICATIONS

The present application is a continuation application of International Application No. PCT/CN2022/077677, filed on Feb. 24, 2022, which claims priority to Chinese Patent Application No. 202110282174.1, filed on Mar. 16, 2021. The disclosures of the above-mentioned applications are incorporated herein by reference in their entireties.

TECHNICAL FIELD

The present application relates to the technical field of mechanical engineering, in particular to a boom correction method and a boom correction device for a working machine.

BACKGROUND

The boom is one of the most important parts in a working machine. When the boom drop problem occurs, it indicates that the fault of the working machine has deteriorated, which seriously affects the reliability and accuracy of the action of the working machine. Therefore, the boom needs to be inspected and corrected to ensure the normal operation of the working machine.

Usually, the inspection and correction of the boom of the working machine mainly depends on the inspection and correction at the factory. When the user finds that the boom is abnormal or the boom is dropped during use, he will manually check the relevant parts one by one. Then, the boom is corrected according to the inspection results.

However, due to the complex working conditions of the working machine, the problem of the boom drop involves many components. The manual maintenance method after the event not only has low maintenance efficiency, but also has a long maintenance cycle and untimely maintenance. In addition, the problem of the boom drop will have a great impact after the occurrence of the problem. If the maintenance is not timely, it will have a significant impact on the user.

SUMMARY

The present application provides a boom correction method and a boom correction device for a working machine, which are used to solve the defects of low maintenance efficiency, long maintenance cycle and untimely maintenance in the related art, and realize automatic and timely correction of the boom of the working machine.

The present application provides a boom correction method for a working machine, including:

inputting an actual displacement value of a boom of a target working machine at a current moment and a first operating parameter of the target working machine at the current moment into a prediction model, and outputting a predicted displacement value of the boom at a next moment of the current moment; and calculating a difference between the predicted displacement value of the boom and a preset displacement value, and in response to that the difference is greater than a first preset threshold, adjusting a second operating parameter of the target working machine according to the difference to correct the boom of the target working machine; both the first operating parameter and the second operating parameter are related to a displacement of the boom.

According to the boom correction method for the working machine of the present application, after the adjusting the second operating parameter of the target working machine according to the difference to correct the boom of the target working machine, the boom correction method further includes:

in response to that a total number of times the boom of the target working machine is corrected within a first preset time period before the next time is greater than a second preset threshold, and in response to that the difference between the predicted displacement value of the boom at a next moment of the next moment and the preset displacement value is greater than the first preset threshold, sending an alarm information to a client to prompt an user to correct the boom of the target operating machine according to the alarm information.

According to the boom correction method for the working machine of the present application, the alarm information includes the actual displacement value of the boom at each moment within a second preset time period, the first operating parameter of the target working machine at each moment within the second preset time period, the predicted displacement value of the boom at each moment within the second preset time period, and the difference between the predicted displacement value of the boom and the preset displacement value at each moment within the second preset time period.

According to the boom correction method for the working machine of the present application, the first operating parameter includes a pressure of a main pump of the target working machine, a pressure of a cylinder large cavity of the boom, a rotational speed of an engine, and a pilot pressure of the boom.

According to the boom correction method for the working machine of the present application, the inputting the actual displacement value of the boom of the target working machine at the current moment and the first operating parameter of the target working machine at the current moment into the prediction model, and outputting the predicted displacement value of the boom at the next moment of the current moment includes:

preprocessing the first operating parameter;

the preprocessing includes taking the rotational speed of the engine as a logarithm of a logarithmic function, obtaining a value of the logarithmic function, and/or subtracting the pressure of the main pump from the pressure of the main pump before the boom of the target working machine is raised to get a subtraction result, and dividing the subtraction result by a preset coefficient; and inputting the first operating parameter after the preprocessing into the prediction model, and outputting the predicted displacement value of the boom at the next moment of the current moment.

According to the boom correction method for the working machine of the present application, the second operating parameter includes a rotational speed of an engine of the target working machine and/or a pressure of a main pump.

The present application also provides a boom correction device for a working machine, including:

a prediction model, configured to input an actual displacement value of a boom of a target working machine at a current moment and a first operating parameter of the target working machine at the current moment into the prediction model, and output a predicted displacement value of the boom at a next moment of the current moment; and a correction module, configured to calculate a difference between the predicted displacement value of the boom and the preset displacement value, and in response to that the difference is greater than a first preset threshold, adjust a second operating parameter of the target working machine according to the difference to correct the boom of the target working machine; both the first operating parameter and the second operating parameter are related to a displacement of the boom.

According to the boom correction device for the working machine of the present application, the correction module is configured to:

in response to that a total number of times the boom of the target working machine is corrected within a first preset time period before the next time is greater than a second preset threshold, and in response to that the difference between the predicted displacement value of the boom at a next moment of the next moment and the preset displacement value is greater than the first preset threshold, send an alarm information to a client to prompt an user to correct the boom of the target operating machine according to the alarm information.

The present application also provides an electronic device, including a memory, a processor, and a computer program stored on the memory and running on the processor; when the processor executes the program, the steps of the boom correction method for the working machine are implemented.

The present application also provides a non-transitory computer-readable storage medium, on which a computer program is stored; when the computer program is executed by a processor, the steps of the boom correction method for the working machine are implemented.

The present application provides a boom correction method and a boom correction device for a working machine. On the one hand, the actual displacement value of the boom of the target working machine and the first operating parameter of the target working machine are used as the input of the prediction model, and the influence of the subsystem of the target working machine on the displacement of the boom is fully considered, so that the predicted displacement value of the boom is more accurate; on the other hand, according to the difference between the predicted displacement value of the boom and the preset displacement value, it is automatically determined whether the boom has a drop phenomenon, and the boom of the target working machine is automatically corrected according to the difference, and the boom is corrected in time when the boom drop occurs, and the displacement of the boom can be corrected in real time while the target working machine is working.

BRIEF DESCRIPTION OF THE DRAWINGS

In order to more clearly illustrate the embodiments of the present application or the technical solutions in the related art, the accompanying drawings that need to be used in the description of the embodiments or the related art will be briefly introduced below. Obviously, the accompanying drawings in the following description are only some embodiments of the present application, and those skilled in the art can also obtain other drawings according to the structures shown in these drawings without creative effort.

DETAILED DESCRIPTION OF THE EMBODIMENTS

The technical solutions in the embodiments of the present application will be clearly and completely described below with reference to the drawings in the embodiments of the present application. Obviously, the described embodiments are only a part of the embodiments of the present application, rather than all the embodiments. Based on the embodiments in the present application, all other embodiments obtained by those skilled in the art without creative work fall within the protection scope of the present application.

Figure 1:
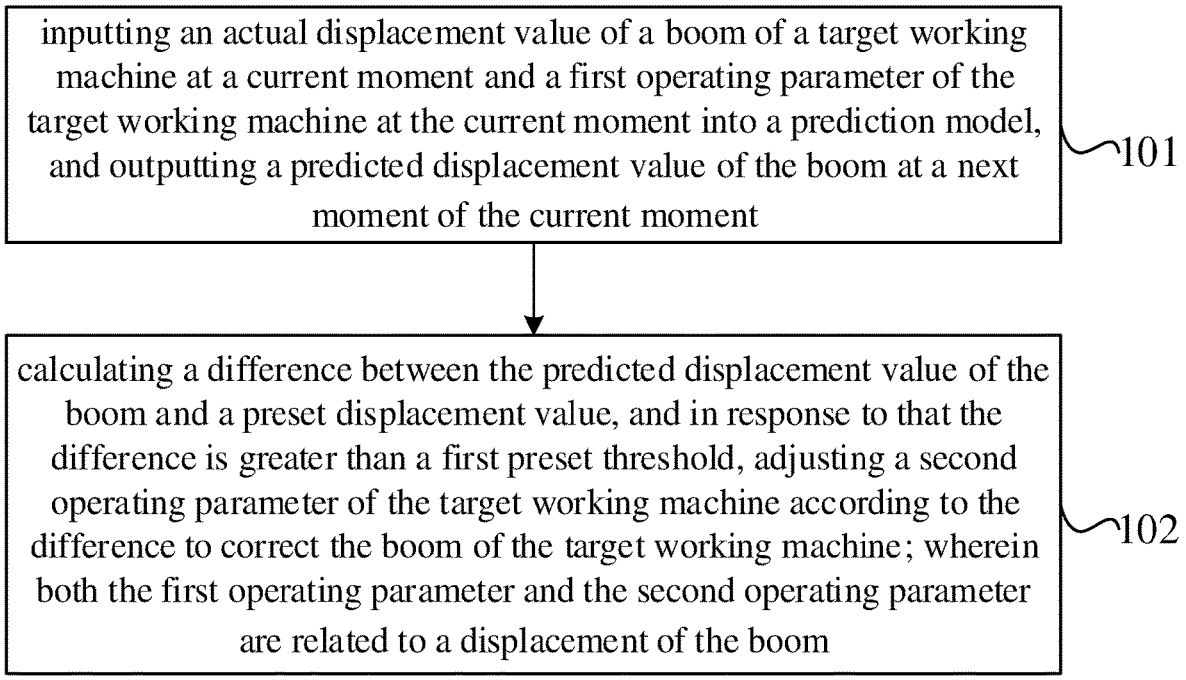
FIG. 1 is a first schematic flowchart of a boom correction method for a working machine provided by the present application.

The boom correction method for the working machine of the present application is described below with reference to FIG. 1, including: step 101, inputting an actual displacement value of a boom of a target working machine at a current moment and a first operating parameter of the target working machine at the current moment into a prediction model, and outputting a predicted displacement value of the boom at a next moment of the current moment.

In an embodiment, the prediction model is a machine learning model, such as a multiple linear regression model. This embodiment is not limited to the type of prediction model.

In an embodiment, the target working machine is an excavator or a loader, and this embodiment is not limited to the type of the target working machine.

In an embodiment, the number of target working machines is one or more, and this embodiment does not specifically limit the number of target work machines. That is, this embodiment can monitor and correct the booms of one or more target working machines at the same time.

In an embodiment, the edge computing module is used to read the actual displacement value of the boom of the target working machine at the current moment from the interface of the pose system of the target working machine, and acquire the first operating parameter of the target working machine at the current moment from the Controller Area Network (CAN) bus of the target working machine.

In an embodiment, the edge computing module also has data storage and computing capabilities.

In an embodiment, the first operating parameter is the operating parameter of the subsystem in the target working machine.

Before the displacement of the boom can be predicted, the prediction model needs to be trained using big data samples. The actual displacement value of the boom of the sample working machine and the first operating parameter at the historical moment are used as the sample, the actual displacement value of the boom of the sample working machine at the historical moment is used as the sample label, and the prediction model is trained until the termination condition is met.

Figure 2:
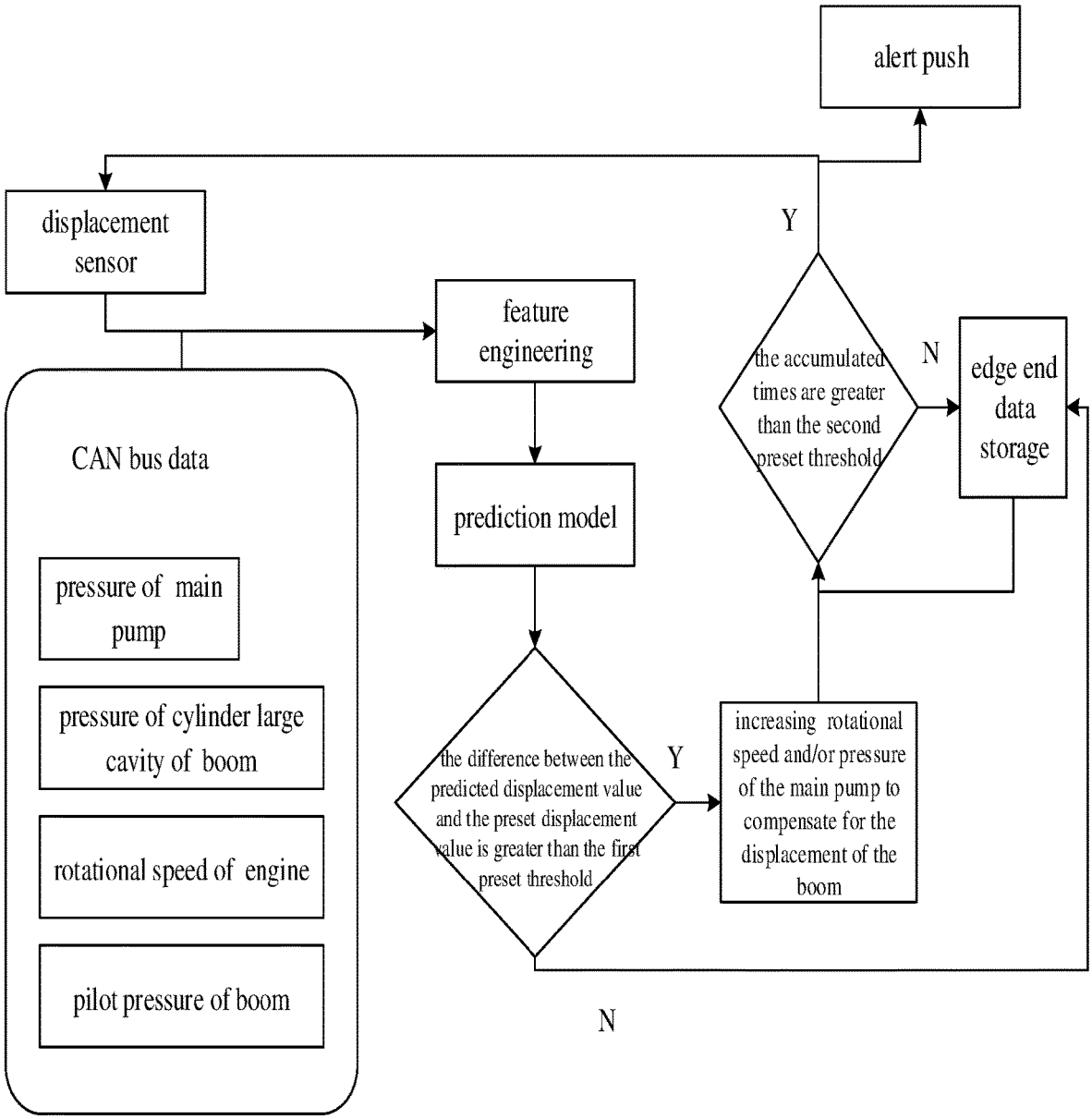
FIG. 2 is a second schematic flowchart of the boom correction method for the working machine provided by the present application.

The actual displacement value of the boom of the target working machine at the current moment and the first operating parameter of the target working machine at the current moment are taken as the input of the prediction model, and the predicted displacement value of the boom of the target working machine at a next moment of the current moment. The specific process is shown in FIG. 2.

The input of the prediction model in this embodiment covers the actual displacement value of the boom of the target working machine at the current moment and the operating parameters of the subsystem, and the influence of the sub-system on the displacement of the boom in the target working machine is fully considered, which is convenient for a comprehensive analysis of the displacement of the boom to obtain a more accurate displacement prediction value of the boom, so as to accurately correct the displacement of the boom.

Step 102, calculating a difference between the predicted displacement value of the boom and a preset displacement value, and in response to that the difference is greater than a first preset threshold, adjusting a second operating parameter of the target working machine according to the difference to correct the boom of the target working machine; both the first operating parameter and the second operating parameter are related to a displacement of the boom.

In an embodiment, the preset displacement value is the displacement value of the boom of the target working machine in a normal operating state.

In an embodiment, the second operating parameter is the operating parameter of the subsystem in the target working machine, the second operating parameter may be the same as or different from the first operating parameter, and the second operating parameter is not specifically limited in this embodiment.

After the predicted displacement value of the boom is obtained, the difference between the predicted displacement value of the boom and the preset displacement value is calculated, and whether the difference is greater than the first preset threshold is determined. The first preset threshold may be set according to actual requirements.

If the difference is not greater than the first preset threshold, the boom is running normally, and the acquired relevant data can be stored at the edge and continue to monitor the boom.

In an embodiment, the relevant data includes the actual displacement value and the first operating parameter of the boom of the target working machine at the current moment, and the predicted displacement value and the calculated difference of the boom at the next moment of the current moment.

If the difference is greater than the first preset threshold, the boom has a drop phenomenon that deviates from the normal working range, and the displacement of the boom needs to be corrected to slow down the drop phenomenon of the boom.

When correcting the boom, the second operating parameter of the target working machine may be adjusted according to the difference, so as to correct the displacement of the boom of the target working machine.

After correcting the boom, the next moment is taken as the new current moment, the actual displacement value and the first operating parameter of the target working machine at the new current moment is input into the prediction model, and the predicted displacement value of the boom at the next moment of the new current moment is output. The above steps are repeated to continue to monitor and correct the boom.

In this embodiment, whether the boom is dropped is monitored in real time according to the difference between the predicted displacement value of the boom and the preset displacement value. And when the target working machine is working, the displacement of the boom can be automatically corrected in real time according to the difference, so as to slow down the boom drop phenomenon.

In addition, based on the edge computing module to obtain data, store data and calculate data, it not only has high flexibility, but also can store the relevant data of the target working machine at various times, and can also acquire whether the boom drop phenomenon occurs by calculation, which can effectively reduce the amount of data upload and reduce the pressure on the database.

On the one hand, this embodiment combines the actual displacement value of the boom of the target working machine and the first operating parameter of the target working machine as the input of the prediction model, and the influence of the sub-system of the target working machine on the displacement of the boom is fully considered, so that the predicted displacement value of the boom is more accurate; on the other hand, according to the difference between the predicted displacement value of the boom and the preset displacement value, it is automatically determined whether the boom has a drop phenomenon, and based on the difference, the target working machine is automatically corrected. The boom is corrected in time when the boom drop phenomenon occurs, and the displacement of the boom can be corrected in real time when the target working machine is working.

On the basis of the above-mentioned embodiment, in this embodiment, after the second operating parameter of the target working machine is adjusted according to the difference value to correct the boom of the target working machine, and further includes: in response to that a total number of times the boom of the target working machine is corrected within a first preset time period before the next time is greater than a second preset threshold, and in response to that the difference between the predicted displacement value of the boom at a next moment of the next moment and the preset displacement value is greater than the first preset threshold, sending an alarm information to a client to prompt an user to correct the boom of the target operating machine according to the alarm information.

In an embodiment, the first preset time period before the next moment includes the current moment and a period of time before the current moment.

In an embodiment, the first preset time period and the second preset threshold may be set according to actual requirements.

In an embodiment, assuming that the current moment is the Nth moment within the first preset time period, the next moment of the current moment is the N+1th moment within the first preset time period, and the next moment of the next moment is the N+2th moment within the first preset time period.

If the displacement of the boom is corrected at any time within the first preset time period, the value of the counter is incremented by 1. When the displacement of the boom is corrected at the Nth moment, if the value of the counter is increased by 1 and is greater than the second preset threshold, and it is obtained through monitoring that the displacement of the boom needs to be corrected at the N+1th moment, it indicates that the number of times the displacement correction of the boom is performed within the first preset time period is too frequent. In this case, the alarm information needs to be pushed to the client. The user can correct the boom of the target working machine according to the alarm information.

In this example, not only can the displacement of the boom be automatically corrected online, but also when the correction is too frequent, the alarm information can be pushed in time, so that the operation and maintenance engineer can repair the target working machine in time to avoid the continuous deterioration of the failure problem. Thus, predictive maintenance of target work machines is achieved.

On the basis of the above-mentioned embodiment, the alarm information in this embodiment includes the actual displacement value of the boom at each moment within a second preset time period, the first operating parameter of the target working machine at each moment within the second preset time period, the predicted displacement value of the boom at each moment within the second preset time period, and the difference between the predicted displacement value of the boom and the preset displacement value at each moment within the second preset time period.

Specifically, the alarm information may include alarm prompt information, such as "boom failure". It may also include data stored at the edge at each moment within the second preset duration. This embodiment is not limited to the content of the alarm information.

In an embodiment, the data stored at the edge end includes the actual displacement value of the boom at each moment, the first operating parameter of the target working machine, the predicted displacement value of the boom, and the difference between the predicted displacement value of the boom and the preset displacement value.

In an embodiment, the second preset duration includes the aforementioned next moment and a period of time before the next moment. The second preset duration can be set according to actual needs. The second preset duration may be the same as or different from the first preset time period.

On the basis of the above embodiments, the first operating parameter in this embodiment includes the pressure of the main pump of the target working machine, the pressure of the cylinder large cavity of the boom, the speed of the engine and the pilot pressure of the boom.

Specifically, the operating parameters of each subsystem of the target working machine will affect the displacement of the boom. Therefore, in this embodiment, the influence of each subsystem of the target working machine on the displacement of the boom is fully considered, and the potential mathematical relationship between each subsystem and the displacement of the boom is explored, so that the obtained predicted displacement value of the boom is more reliable and accurate.

On the basis of the above embodiment, in this embodiment, the inputting the actual displacement value of the boom of the target working machine at the current moment and the first operating parameter of the target working machine at the current moment into the prediction model, and outputting the predicted displacement value of the boom at the next moment of the current moment, including: preprocessing the first operating parameter; the preprocessing includes taking the rotational speed of the engine as a logarithm of a logarithmic function, obtaining a value of the logarithmic function, and/or subtracting the pressure of the main pump from the pressure of the main pump before the boom of the target working machine is raised to get a subtraction result, and dividing the subtraction result by a preset coefficient; and inputting the first operating parameter after the preprocessing into the prediction model, and outputting the predicted displacement value of the boom at the next moment of the current moment.

Specifically, before inputting the actual displacement value of the boom of the target working machine at the current moment and the first operating parameter into the prediction model, the first operating parameter may be preprocessed.

In an embodiment, the way of preprocessing the rotational speed of the engine is to perform logarithmic calculation on the rotational speed of the engine.

In an embodiment, the way of preprocessing the pressure of the main pump is to subtract the pressure of the main pump from the static pressure of the main pump before the boom lifts the arm, and then divide it by a preset coefficient. The preset coefficients can be set according to actual needs.

In addition, the pressure of the cylinder large cavity of the boom, the rotational speed of the engine and the pilot pressure of the boom can also be preprocessed according to the way of pre-processing of the pressure of the main pump.

The preprocessed first operating parameter and the actual displacement value of the boom may also be preprocessed by normalization.

By using the preprocessed first operating parameter and the actual displacement value of the boom as independent variables to establish a prediction model, not only the reliability of the prediction model can be improved, but also the complexity and calculation time of the model can be reduced.

Based on the above embodiments, the second operating parameter in this embodiment includes the rotational speed of the engine of the target working machine and/or the pressure of the main pump.

Specifically, the phenomenon that the boom drop occurs may be caused by insufficient pressure of the hydraulic system. The problem of insufficient pressure in the hydraulic system can be compensated by increasing the pressure of the main pump, and/or the rotational speed of the engine.

In an embodiment, the control command is generated according to the difference between the predicted displacement value of the boom and the preset displacement value, and the control command is issued to the control system of the target working machine. The control system increases the rotational speed of the engine and/or the pressure of the main pump according to the control command to compensate the displacement of the boom, so as to alleviate the boom drop phenomenon.

The boom correction device for the working machine provided by the present application is described below, and the boom correction device for the working machine described below and the boom correction method for the working machine described above can be referred to each other correspondingly.

Figure 3:
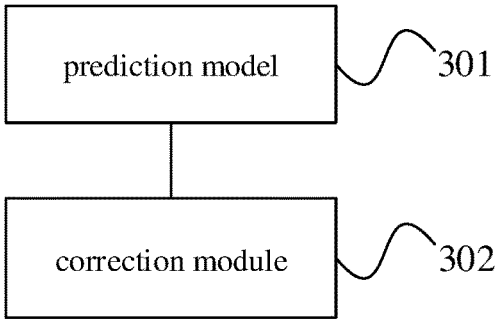
FIG. 3 is a structural schematic diagram of a boom correction device for a working machine provided by the present application.

As shown in FIG. 3, a boom correction device for a working machine provided in this embodiment includes a prediction module 301 and a correction module 302.

The prediction module 301 is configured to input the actual displacement value of the boom of the target working machine at the current moment and the first operating parameter of the target working machine at the current moment into the prediction model, and output the displacement prediction value of the boom at the next moment of the current moment.

In an embodiment, the prediction model is a machine learning model, such as a multiple linear regression model. This embodiment is not limited to the type of prediction model.

In an embodiment, the target working machine is an excavator or a loader, and this embodiment is not limited to the type of the target working machine.

In an embodiment, the number of target working machines is one or more, and this embodiment does not specifically limit the number of target working machines. That is, the present embodiment can monitor and correct the booms of one or more target machines at the same time.

In an embodiment, the edge computing module is used to read the actual displacement value of the boom of the target working machine at the current moment from the interface of the pose system of the target working machine, and the first operating parameter of the target working machine at the current moment is obtained from the CAN bus of the target machine.

In an embodiment, the edge computing module also has data storage and computing capabilities.

In an embodiment, the first operating parameter is the operating parameter of the subsystem in the target working machine.

Before the displacement of the boom can be predicted, the prediction model needs to be trained using big data samples. The actual displacement value of the boom and the first operating parameter of the sample working machine at the historical moment are used as the sample, and the actual displacement value of the boom of the sample working machine at the historical moment is used as the sample label. The prediction model is trained until the termination condition is met.

The actual displacement value of the boom of the target working machine at the current moment and the first operating parameter of the target working machine at the current moment are taken as the input of the prediction model, and the predicted displacement value of the boom of the target working machine at the current moment and the next moment is output. The specific process is shown in FIG. 2.

The input of the prediction model in this embodiment covers the actual displacement value of the boom of the target working machine at the current moment and the operating parameters of the subsystem, and the influence of the sub-system on the displacement of the boom in the target working machine is fully considered, which is convenient for comprehensive analysis of the displacement of the boom to obtain a more accurate predicted displacement value of the boom, so as to accurately correct the displacement of the boom.

The correction module 302 is configured to calculate the difference between the predicted displacement value of the boom and the preset displacement value. If the difference is greater than the first preset threshold, then according to the difference, the second operating parameter of the target working machine is adjusted to correct the boom of the target working machine; the first and second operating parameters are both related to the displacement of the boom.

In an embodiment, the preset displacement value is the displacement value of the boom of the target working machine in a normal operating state.

In an embodiment, the second operating parameter is the operating parameter of the subsystem in the target working machine, and the second operating parameter may be the same as or different from the first operating parameter. The second operating parameter is not specifically limited in this embodiment.

After the predicted displacement value of the boom is obtained, the difference between the predicted displacement value of the boom and the preset displacement value is calculated, and whether the difference is greater than the first preset threshold is determined. The first preset threshold may be set according to actual requirements.

If the difference is not greater than the first preset threshold, the boom is running normally, and the acquired relevant data can be stored at the edge end and the monitoring of the boom continues.

In an embodiment, the relevant data includes the actual displacement value and the first operating parameter of the boom of the target working machine at the current moment, and the predicted displacement value and the calculated difference of the boom at the next moment of the current moment.

If the difference is greater than the first preset threshold, the boom has a drop phenomenon that deviates from the normal working range, and the displacement of the boom needs to be corrected to slow down the drop phenomenon of the boom.

When correcting the boom, the second operating parameter of the target working machine may be adjusted according to the difference, so as to correct the displacement of the boom of the target working machine.

After correcting the boom, the next moment is taken as the new current moment. The actual displacement value and the first operating parameter of the target working machine at the new current moment is input into the prediction model, and the predicted displacement value of the boom at the next moment of the new current moment is output. The above steps are repeated to continue to monitor and correct the boom.

In this embodiment, whether the boom is dropped is monitored in real time according to the difference between the predicted displacement value of the boom and the preset displacement value. When the target working machine is working, the displacement of the boom can be automatically corrected in real time according to the difference, so as to slow down the boom drop phenomenon.

In addition, based on the edge computing module to obtain data, store data and calculate data, it not only has high flexibility, but also can store the relevant data of the target working machine at various times, and can also calculate whether the boom has drop phenomenon, which can effectively reduce the amount of data upload and reduce the pressure on the database.

On the one hand, this embodiment combines the actual displacement value of the boom of the target working machine and the first operating parameter of the target working machine as the input of the prediction model, and the influence of the sub-system of the target working machine on the displacement of the boom is fully considered, so that the predicted displacement value of the boom is more accurate; on the other hand, according to the difference between the predicted displacement value of the boom and the preset displacement value, it is automatically determined whether the boom has drop phenomenon, and based on the difference, the target working machine is automatically corrected. The boom is corrected in time when the boom drop phenomenon occurs, and the displacement of the boom can be corrected in real time when the target working machine is working.

On the basis of the above-mentioned embodiment, the correction module in this embodiment is specifically configured to: if the total number of times of correcting the boom of the target working machine within the first preset time period before the next time is greater than the second preset threshold, and the difference between the predicted displacement value of the boom at the next moment of the next moment and the preset displacement value is greater than the first preset threshold, send an alarm information to the client to prompt the user to correct the boom of the target working machine according to the warning information.

On the basis of the above-mentioned embodiment, the alarm information in this embodiment includes the actual displacement value of the boom at each moment within the second preset time period, the first operating parameter of the target working machine at each time within the second preset time period, the predicted displacement value of the boom at each time in the second preset time period, and the difference between the predicted displacement value of the boom at each time in the second preset time period and the preset displacement value.

On the basis of the above embodiments, the first operating parameter in this embodiment includes the pressure of the main pump of the target working machine, the pressure of the cylinder large cavity of the boom, the rotational speed of the engine and the pilot pressure of the boom.

On the basis of the above embodiment, the prediction module in this embodiment is specifically configured to: preprocess the first operating parameter; the preprocessing includes taking the rotational speed of the engine as the logarithm in the logarithmic function, obtaining the value of the logarithmic function, and/or subtracting the pressure of the main pump from the pressure of the main pump before the boom of the target working machine is raised, and dividing the subtraction result by a preset coefficient; the preprocessed first operation parameter is input into the prediction model, and the predicted displacement value of the boom at the next moment of the current moment is output.

Based on the above embodiments, the second operating parameter in this embodiment includes the rotational speed of the engine of the target working machine and/or the pressure of the main pump.

Figure 4:
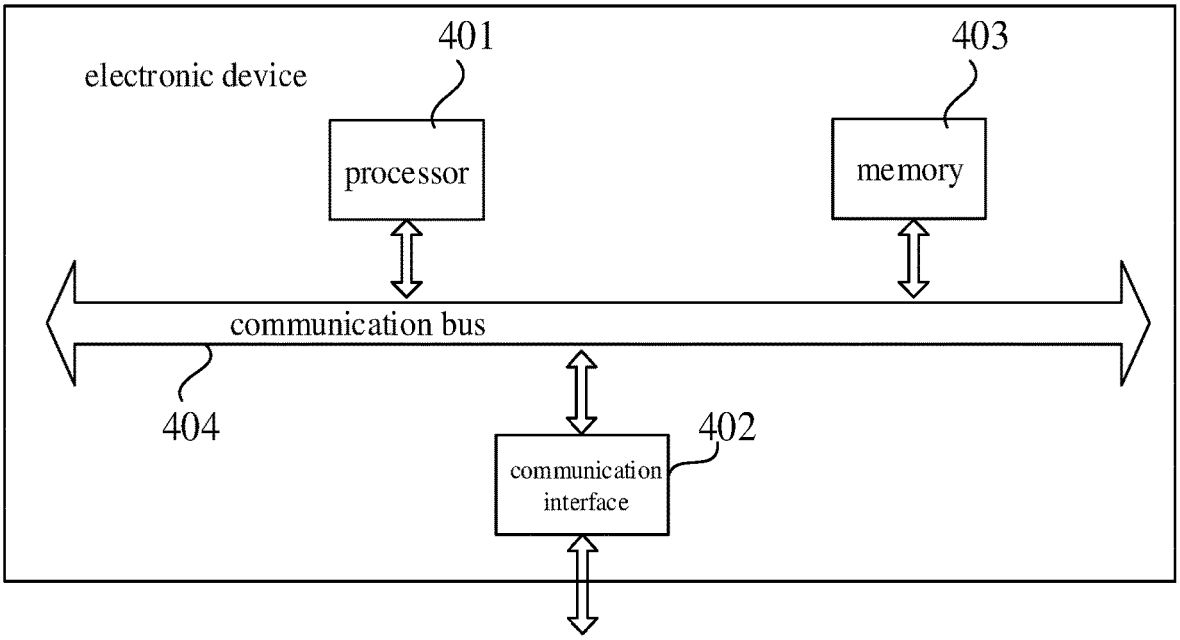
FIG. 4 is a structural schematic diagram of an electronic device provided by the present application.

FIG. 4 illustrates a schematic diagram of the physical structure of an electronic device. As shown in FIG. 4, the electronic device may include: a processor 401, a communication interface 402, a memory 403 and a communication bus 404. The processor 401, the communication interface 402, and the memory 403 communicate with each other through the communication bus 404. The processor 401 can call the logic instructions in the memory 403 to execute the boom correction method for the working machine, the method including: inputting an actual displacement value of a boom of a target working machine at a current moment and a first operating parameter of the target working machine at the current moment into a prediction model, and outputting a predicted displacement value of the boom at a next moment of the current moment; and calculating a difference between the predicted displacement value of the boom and a preset displacement value, and in response to that the difference is greater than a first preset threshold, adjusting a second operating parameter of the target working machine according to the difference to correct the boom of the target working machine; both the first operating parameter and the second operating parameter are related to a displacement of the boom.

In addition, the above-mentioned logic instructions in the memory 403 can be implemented in the form of software functional units and can be stored in a computer-readable storage medium when sold or used as an independent product. Based on this understanding, the technical solution of the present application can be embodied in the form of a software product in essence, or the part that contributes to the prior art or the part of the technical solution. The computer software product is stored in a storage medium, including several instructions used to cause a computer device (which may be a personal computer, a server, or a network device, etc.) to execute all or part of the steps of the methods described in the various embodiments of the present application. The aforementioned storage medium includes: U disk, mobile hard disk, Read-Only Memory (ROM), Random Access Memory (RAM), magnetic disk or optical disk and other media that can store program codes.

In another aspect, the present application also provides a computer program product. The computer program product includes a computer program stored on a non-transitory computer-readable storage medium, and the computer program includes program instructions, when the program instructions are executed by a computer, the computer can execute the boom correction method for the working machine provided by the above methods. The method includes: inputting an actual displacement value of a boom of a target working machine at a current moment and a first operating parameter of the target working machine at the current moment into a prediction model, and outputting a predicted displacement value of the boom at a next moment of the current moment; and calculating a difference between the predicted displacement value of the boom and a preset displacement value, and in response to that the difference is greater than a first preset threshold, adjusting a second operating parameter of the target working machine according to the difference to correct the boom of the target working machine; both the first operating parameter and the second operating parameter are related to a displacement of the boom.

In another aspect, the present application also provides a non-transitory computer-readable storage medium, on which a computer program is stored, and when the computer program is executed by a processor, the above-mentioned boom correction method for the working machine is implemented, the method includes: inputting an actual displacement value of a boom of a target working machine at a current moment and a first operating parameter of the target working machine at the current moment into a prediction model, and outputting a predicted displacement value of the boom at a next moment of the current moment; and calculating a difference between the predicted displacement value of the boom and a preset displacement value, and in response to that the difference is greater than a first preset threshold, adjusting a second operating parameter of the target working machine according to the difference to correct the boom of the target working machine; both the first operating parameter and the second operating parameter are related to a displacement of the boom.

Embodiments of the device described above are only illustrative. The units described as separate components may or may not be physically separated, and the components shown as units may or may not be physical units, that is, they may be located in one place, or can be distributed over multiple network elements. Some or all of the modules may be selected according to actual needs to achieve the purpose of the solution in this embodiment. Those skilled in the art can understand and implement it without creative effort.

From the description of the above embodiments, those skilled in the art can clearly understand that each embodiment can be implemented by means of software plus a necessary general hardware platform, and certainly can also be implemented by hardware. Based on this understanding, the above-mentioned technical solutions can be embodied in the form of software products in essence or the parts that make contributions to the prior art, and the computer software products can be stored in computer-readable storage media, such as ROM/RAM, a magnetic disc, an optical disc, etc., including several instructions for causing a computer device (which may be a personal computer, a server, or a network device, etc.) to perform the methods described in various embodiments or some parts of the embodiments.

Finally, it should be noted that the above embodiments are only used to illustrate the technical solutions of the present application, but not to limit them; although the present application has been described in detail with reference to the foregoing embodiments, those skilled in the art should understand that: the technical solutions described in the foregoing embodiments can be modified, or some technical features thereof can be equivalently replaced; and these modifications or replacements do not make the essence of the corresponding technical solutions deviate from the spirit and scope of the technical solutions in the embodiments of the present application.

What is claimed is:

1. A boom correction method for a working machine, comprising:

inputting an actual displacement value of a boom of a target working machine at a current moment and a first operating parameter of the target working machine at the current moment into a prediction model, and outputting a predicted displacement value of the boom at a next moment of the current moment; and calculating a difference between the predicted displacement value of the boom and a preset displacement value, and in response to that the difference is greater than a first preset threshold, adjusting a second operating parameter of the target working machine according to the difference to correct the boom of the target working machine; wherein both the first operating parameter and the second operating parameter are related to a displacement of the boom;

wherein the first operating parameter comprises a pressure of a main pump of the target working machine, a pressure of a cylinder large cavity of the boom, a rotational speed of an engine, and a pilot pressure of the boom; and wherein the inputting the actual displacement value of the boom of the target working machine at the current moment and the first operating parameter of the target working machine at the current moment into the prediction model, and outputting the predicted displacement value of the boom at the next moment of the current moment comprises:

preprocessing the first operating parameter; wherein, the preprocessing comprises taking the rotational speed of the engine as a logarithm of a logarithmic function, obtaining a value of the logarithmic function, and/or subtracting the pressure of the main pump from the pressure of the main pump before the boom of the target working machine is raised to get a subtraction result, and dividing the subtraction result by a preset coefficient; and inputting the first operating parameter after the preprocessing into the prediction model, and outputting the predicted displacement value of the boom at the next moment of the current moment.

2. The boom correction method for the working machine according to claim 1, wherein after the adjusting the second operating parameter of the target working machine according to the difference to correct the boom of the target working machine, the boom correction method further comprises:

in response to that a total number of times the boom of the target working machine is corrected within a first preset time period before the next time is greater than a second preset threshold, and in response to that the difference between the predicted displacement value of the boom at a next moment of the next moment and the preset displacement value is greater than the first preset threshold, sending an alarm information to a client to prompt an user to correct the boom of the target operating machine according to the alarm information.

3. The boom correction method for the working machine according to claim 2, wherein the alarm information comprises the actual displacement value of the boom at each moment within a second preset time period, the first operating parameter of the target working machine at each moment within the second preset time period, the predicted displacement value of the boom at each moment within the second preset time period, and the difference between the predicted displacement value of the boom and the preset displacement value at each moment within the second preset time period.

4. The boom correction method for the working machine according to claim 1, wherein the second operating parameter comprises a rotational speed of an engine of the target working machine and/or a pressure of a main pump.

5. An electronic device, comprising a memory, a processor, and a computer program stored on the memory and running on the processor, wherein when the processor executes the program, the steps of the boom correction method for the working machine according to claim 1 are implemented.

6. A non-transitory computer-readable storage medium, on which a computer program is stored, wherein when the computer program is executed by a processor, the steps of the boom correction method for the working machine according to claim 1 are implemented.

* * * * *